US007758292B2

(12) United States Patent
Close et al.

(10) Patent No.: US 7,758,292 B2
(45) **Date of Patent: *Jul. 20, 2010**

(54) SYSTEM AND METHOD FOR UNSLEEVING TRAYS

(75) Inventors: Donald R. Close, Fairfax, VA (US); Robert D. Lundahl, Frederick, MD (US); William D. Finch, New Windsor, MD (US); Robert Cutlip, Millersville, MD (US); Dwight Koogle, Middlletown, MD (US); Mark Bankard, Sykesville, MD (US)

(73) Assignee: United States Postal Service, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/483,735

(22) Filed: Jul. 11, 2006

(65) Prior Publication Data

US 2006/0291984 A1 Dec. 28, 2006

Related U.S. Application Data

(63) Continuation of application No. 10/800,701, filed on Mar. 16, 2004, now abandoned.

(60) Provisional application No. 60/454,626, filed on Mar. 17, 2003.

(51) Int. Cl.
*B65B 69/00* (2006.01)

(52) U.S. Cl. ..... 414/412; 414/929; 209/659; 53/381.2; 53/381.4

(58) Field of Classification Search ..... 414/411–412, 414/414, 416.05, 929; 53/381.1–381.4, 176, 53/492, 75; 209/659
See application file for complete search history.

(56) References Cited

U.S. PATENT DOCUMENTS

| | | | | | |
|---|---|---|---|---|---|
| 2,916,859 | A | * | 12/1959 | Klein | 53/428 |
| 3,889,442 | A | * | 6/1975 | Grahn et al. | 53/492 |
| 4,317,319 | A | * | 3/1982 | Price | 53/76 |
| 4,466,767 | A | * | 8/1984 | Meschi | 414/411 |
| 4,817,260 | A | * | 4/1989 | Martin | 29/426.6 |

(Continued)

FOREIGN PATENT DOCUMENTS

DE 3320459 A1 12/1984

(Continued)

OTHER PUBLICATIONS

International Preliminary Report on Patentability for Int'l. Appln. No. PCT/US2004/007867, mailed Oct. 6, 2005 (8 pages).

(Continued)

*Primary Examiner*—James Keenan
(74) *Attorney, Agent, or Firm*—Finnegan, Henderson, Farabow, Garrett & Dunner, LLP

(57) ABSTRACT

A system for unstrapping and unsleeving a tray is provided. The system comprises a tray-transport configured to transport a tray in the system, a strap cutter configured to cut a strap on the tray, a strap-removal portion configured to remove the strap cut by the strap cutter, and an unsleeving station configured to remove a sleeve from the tray. The unsleeving station is configured to remove the sleeve from the tray after the strap-removal portion removes the cut strap.

44 Claims, 11 Drawing Sheets

U.S. PATENT DOCUMENTS

| | | | | | |
|---|---|---|---|---|---|
| 4,838,751 | A * | 6/1989 | Hanaya et al. | 414/412 |
| 4,976,583 | A * | 12/1990 | Moltrasio | 414/810 |
| 4,995,784 | A * | 2/1991 | Boisseau | 414/810 |
| 5,059,082 | A * | 10/1991 | Tanttu et al. | 414/412 |
| 5,074,739 | A * | 12/1991 | Takahashi et al. | 414/412 |
| 5,156,516 | A * | 10/1992 | Boisseau | 414/412 |
| 5,179,878 | A * | 1/1993 | Kranefeld et al. | 83/13 |
| 5,318,399 | A * | 6/1994 | Marom | 414/412 |
| 5,361,562 | A * | 11/1994 | Nagaoka et al. | 53/492 |
| 5,379,570 | A * | 1/1995 | Terjung et al. | 53/399 |
| 5,481,854 | A * | 1/1996 | Van Newkirk | 53/458 |
| 5,588,276 | A * | 12/1996 | Terjung et al. | 53/399 |
| 5,657,617 | A * | 8/1997 | Allen et al. | 53/487 |
| 6,098,373 | A * | 8/2000 | Ashikawa et al. | 53/381.2 |
| 6,311,822 | B1 * | 11/2001 | LeCroy | 198/358 |
| 6,402,452 | B1 * | 6/2002 | Miller et al. | 414/412 |
| 6,561,360 | B1 * | 5/2003 | Kalm et al. | 209/606 |
| 6,604,337 | B2 * | 8/2003 | Close et al. | 53/75 |
| 6,688,084 | B2 * | 2/2004 | Yarbrough | 53/589 |
| 6,694,852 | B1 * | 2/2004 | Ours et al. | 83/861 |
| 6,863,486 | B2 * | 3/2005 | Ours et al. | 414/412 |
| 7,021,033 | B2 * | 4/2006 | Close et al. | 53/492 |
| 7,174,695 | B2 * | 2/2007 | Porter et al. | 53/381.2 |
| 2004/0055438 | A1 * | 3/2004 | Ours et al. | 83/861 |

FOREIGN PATENT DOCUMENTS

| | | | |
|---|---|---|---|
| EP | 0 947 428 | A1 | 10/1999 |
| JP | 01 04 5238 | A | 2/1989 |
| JP | 03 085238 | A | 4/1991 |

OTHER PUBLICATIONS

International Search Report and Written Opinion for Int'l. Appln. No. PCT/US2004/007867, mailed Oct. 12, 2004 (12 pages).

* cited by examiner

SYSTEM AND METHOD FOR UNSLEEVING TRAYS

RELATED APPLICATIONS

This application is a continuation of application Ser. No. 10/800,701, filed Mar. 16, 2004, now abandoned which claims benefit of priority under 35 U.S.C. §119(e) of U.S. provisional application No. 60/454,626 filed Mar. 17, 2003, which is hereby incorporated by reference.

BACKGROUND OF THE INVENTION

1. Field of the Invention

The invention relates generally to the automated handling of boxes during shipping.

2. Description of the Related Art

It is common in the shipping business to ship items, such as letters and packages, in different sized strapped-sleeved trays ("SST") 100, as shown in FIG. 1(*a*). Typically, items 101, such as letters, are placed in unstrapped and unsleeved trays 102 and then sheathed in a sleeve 110 for protection during handling. Sleeve 110 can be of an open-ended flat or tubular packaging design to fit over trays 102. Binding sleeves 110 with a strap 120 ensures that sleeves 110 remain secure over trays 102. Strap 120 can be a narrow strip of a flexible material. Items 101 often need to be removed once SST 100 reaches the next processing point. To access items 101, strap 120 must be removed, and tray 102 extracted from sleeve 110.

Historically, this process has been done by hand. An operator receives SST 100 and manually cuts strap 120 and pulls tray 102 out of sleeve 110. Trays 102 are then typically fed downstream for further processing and another operator sorts empty sleeves 110. While effective, this method is slow and repetitive and requires at least one full-time operator, increasing the cost of shipping.

As the shipping and routing industry has grown, there has been a push towards automation. Automation increases speed and eliminates the need for a full-time operator.

Accordingly, a need exists for a system that can automatically process bound sleeves and trays. The system must be capable of handling and sorting different sizes of trays that are common in today's shipping industry. The system must also be able to quickly and efficiently cut the binding strap and remove the tray from the sleeve. To increase efficiency, the system must also be able to sort the empty sleeves according to size for reuse. All these steps should be automated and capable of integration into the overall routing system.

SUMMARY

In the following description, certain aspects and embodiments of the present invention are disclosed. It should be understood that the invention, in its broadest sense, could be practiced without having one or more features of these aspects and embodiments. In other words, these aspects and embodiments are merely exemplary.

One aspect relates to a system that limits or overcomes one or more drawbacks of the related art. In this aspect, a system for unstrapping and unsleeving a tray is provided that comprises a tray-transport configured to transport a tray in the system, a strap cutter configured to cut a strap on the tray, a strap-removal portion configured to remove the strap cut by the strap cutter, and an unsleeving station configured to remove a sleeve from the tray. The unsleeving station is configured to remove the sleeve from the tray after the strap-removal portion removes the cut strap.

In another aspect, the tray-transport comprises a tray-sizing station configured to determine the size of the tray. In a particular embodiment, the tray-sizing station may comprise a sensor configured to determine the height of the tray, a sensor configured to determine the length of the tray, or both. In some embodiments, the sensors may be a photo-reflective zone sensor or a contact arm microswitch.

In yet another aspect, the tray-transport comprises a traffic control device configured to regulate tray traffic in the system.

In another aspect, the system further comprises a sleeve-transport conveyor configured to move empty sleeves.

In still another aspect, the system further comprises a safety enclosure configured to protect personnel from injury during system operation.

In even another aspect, the system further comprises a control system configured to control and monitor the system. In this embodiment, the control system may comprise a computer. The system may also comprise at least one emergency stop switch configured to stop the system.

In yet another aspect, the tray-transport comprises a powered roller. In this embodiment, the powered roller may be a zero-pressure accumulation conveyor.

In still another aspect, the tray-transport comprises a mail catcher configured to catch loose items.

In another aspect, the tray-transport comprises a tray centering guide configured to center the tray.

In even another aspect, the strap-removal portion comprises a vacuum takeaway.

In yet another aspect, the system further comprises a transfer device configured to push the destrapped tray onto the unsleeving station.

In other aspects, the strap cutter comprises a rotating. saw blade and a flexible spatula. Alternatively, the strap cutter may comprise a hooked blade and a flexible spatula. In other embodiments, the strap cutter is configured to cut the strap above the tray and the strap-removal portion is configured to remove the cut strap below the tray. In another embodiment, the strap-removal portion is configured to remove the cut strap near the center of the cut strap.

In another aspect, the strap-removal portion comprises a strap chopping portion configured to chop the cut straps.

In even further aspects, the unsleeving station comprises a sleeve-expander configured to lift the top of the sleeve. Additionally, the sleeve-expander may also comprise a gripper configured to grip the top of the sleeve. Further, the gripper may comprise vacuum cups.

In at least one other aspect, the unsleeving station comprises a push ram configured to push the tray out of the sleeve. In some embodiments, the push ram comprises a sweeping device configured to remove loose mail from an empty sleeve.

In other aspects, the system further comprises a sleeve-sorting station configured to sort empty sleeves. In some embodiments, the unsleeving station comprises a sleeve-transport conveyor configured to transport empty sleeves to the sleeve-sorting station. In even other embodiments, the sleeve-sorting station comprises at least one container. Further, the sleeve-sorting station may also comprise at least one sleeve-ejector configured to sweep empty sleeves into the at least one container. In even further embodiments, at least one sleeve-ejector may comprise at least one pusher paddle configured to flatten the empty sleeve before sweeping the empty sleeve into the at least one container. In other embodiments, the sleeve-sorting station comprises a floor fixture configured to position the container. In some embodiments, the sleeve-sorting station comprises a basket-full sensor configured to sense over-height stacking of the empty sleeves in the container.

In another aspect, a method for removing a sleeve from a tray with the system described above is provided. The method comprises cutting the strap from the tray with the strap cutter, removing the cut strap with the strap-removal portion, and removing the sleeve from the tray with the unsleeving station. In other embodiments, the method further comprises operating and monitoring the system with a control system. In even other embodiments, the method further comprises sorting the empty sleeve with a sleeve-sorting station. In other embodiments, the method may further comprise chopping the cut straps with a strap chopping portion.

In one aspect, a device is provided for destrapping a strapped bound sleeve. The device comprises a strap cutter including a flexible spatula and a cutting blade opposite to the flexible spatula. The flexible spatula is insertable between a strap and a sleeve over a tray. The device further comprises a strap take-away mechanism positioned below the strap cutter.

In another aspect, a device for shipping and routing items is provided. The device comprises a tray-transport configured to receive a strapped sleeved tray. The tray-transport includes sensors for determining tray size and sleeve size. The device further comprises a destrapping station downstream from the tray-transport, the destrapping station including a strap cutter and a strap takeaway system, and an unsleeving station downstream from the destrapping station. The unsleeving station includes a sleeve-expander which separates the sleeves from trays and feeds the trays to an exit conveyor for further processing. The device may further include a sleeve-transport conveyor positioned downstream from the unsleeving station, which receives sleeves from the sleeve-expander plate, and a sleeve-stacking station positioned downstream from the sleeve-transport conveyor, which sorts the sleeves into a plurality of containers according to sleeve size.

It is to be understood that both the foregoing general description and the following detailed description are exemplary and explanatory only and are not restrictive of the invention, as claimed.

BRIEF DESCRIPTION OF THE DRAWINGS

The invention will be understood more clearly on reading the following description and studying the figures that accompany it. These figures are presented only by way of indication and without implying any limitation of the invention. The accompanying drawings are incorporated in and constitute a part of this specification. The drawings illustrate exemplary embodiments and, together with the description, serve to explain some principles of the invention. In the drawings:

FIG. 1(*b*) is a perspective view of one embodiment of an unsleeving system consistent with the principles of the invention;

FIG. 2(*b*) is a side view of the tray-transport/tray-sizing station of FIG. 2(*a*);

FIG. 3(*b*) is a side view of one embodiment of a rotating saw blade consistent with the principles of the invention;

FIG. 3(*c*) is a perspective view of one embodiment of a hooked blade consistent with the principles of the invention;

DESCRIPTION OF A FEW EXEMPLARY EMBODIMENTS

Figure 1A:
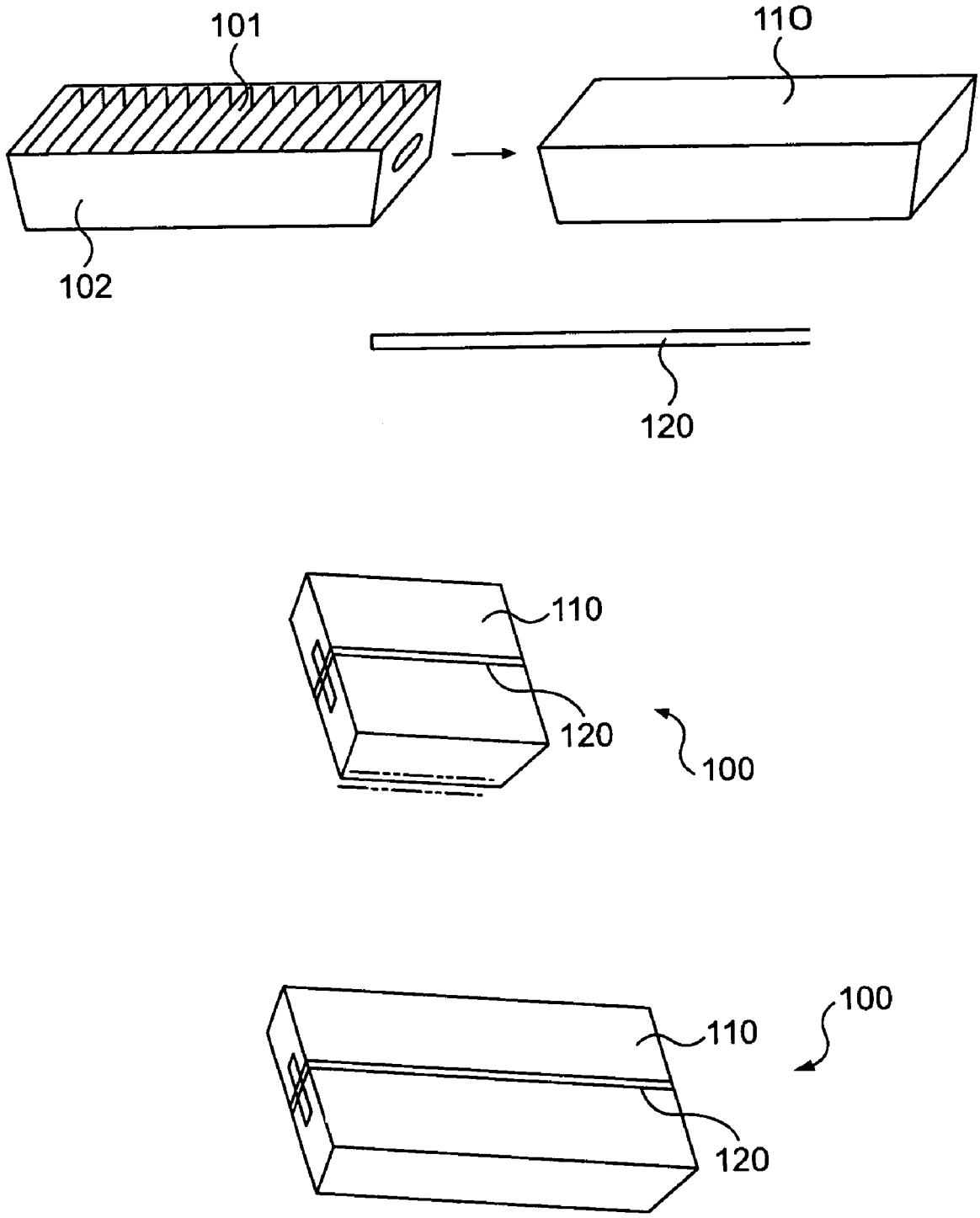
FIG. 1(*a*) is a perspective view of trays, sleeves, and strapped-sleeved trays.

Reference will now be made in detail to a few exemplary embodiments of the invention. Wherever possible, the same reference numbers are used in the drawings and the description to refer to the same or like parts.

Figure 1B:
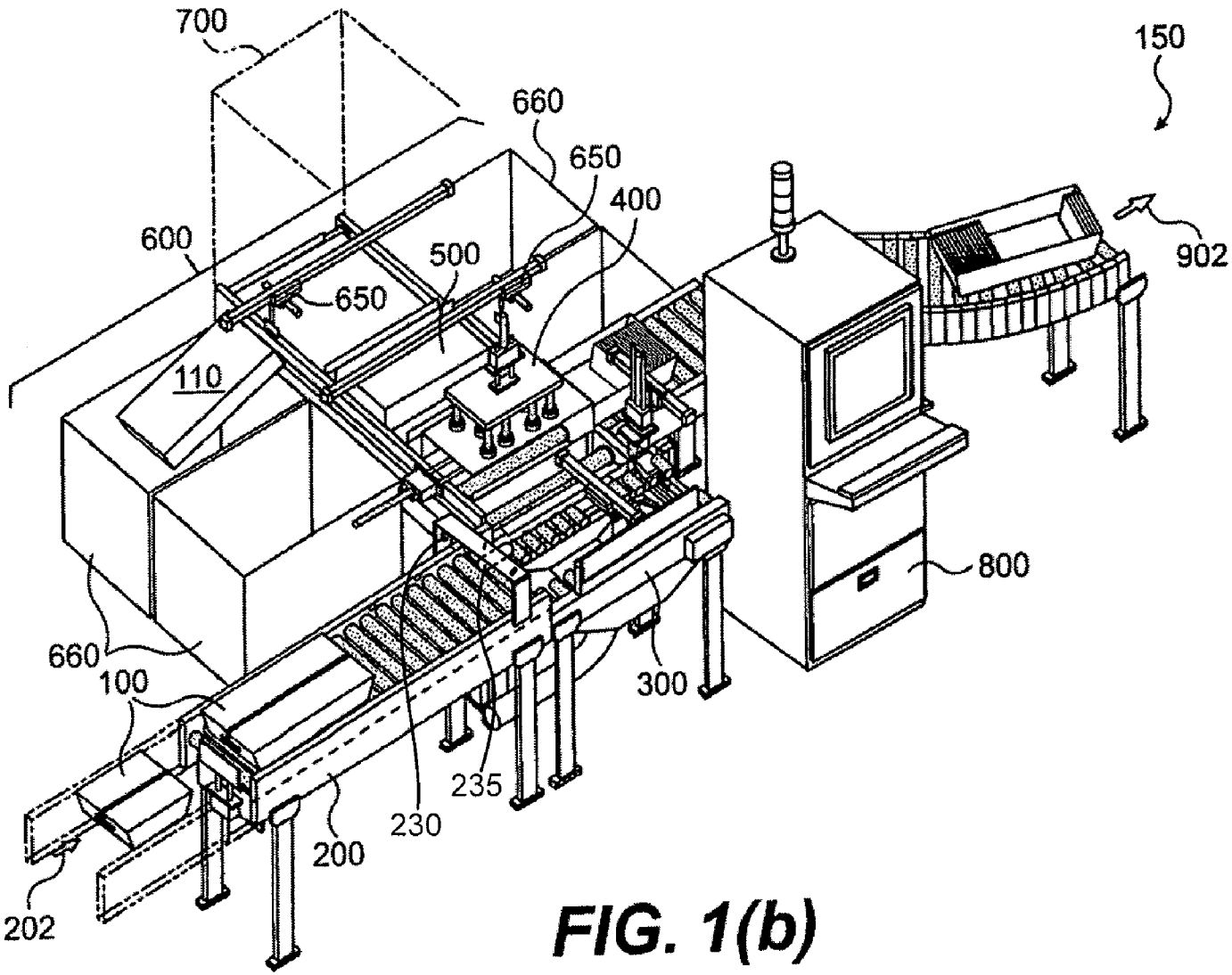

As seen in FIG. 1(*b*), one embodiment of an unsleeving system 150 is designed as a single module that incorporates all functions in a self-contained system. This embodiment places the input and exit conveyor in line, so the system 150 can be conveniently integrated into a straight section of a powered roller conveyor. The system 150 can accept different tray 103 sizes, for example, MM, EMM, ½ MM, and ½ EMM trays. Because the system 150 typically does not fully lift a tray 102, the system 150 can easily handle heavy trays 102. For light trays 102, the system 150 may comprise hold-down guides to prevent light trays from lifting off the conveyors during processing.

In at least one embodiment, the system 150 is configured to detect whether tray 102 has a sleeve 110. If the tray 102 does not have a sleeve 110, the system 150 will pass the tray 102 through the system 150 without processing. In at least one example of this embodiment, the detection is accomplished by two ultrasonic or photo-sensitive sensors, 230 and 235. One of the sensors 230 may be positioned on tray transport 200, above and at an angle with respect to SST 100. If the tray 102 does not have a sleeve 110, the angled sensor 230 will detect the presence of letters 101 instead of the presence of sleeve 110. The other sensor 235 is positioned above SST 100 on tray transport 200 and looks straight down and detects the height of tray 102 and smoothness of tray's 102 surface. If the tray 102 is without a sleeve 110, the surface will be uneven and rough as it detects mail pieces 101. Further, the height of tray 102 will be shorted than the height of a tray 102 with sleeve 110.

In certain embodiments of the present invention, the system can use a multiple-station approach to maximize tray throughput. This keeps the trays flowing so that each tray operation is kept simple and can be performed at a discrete station. Different operations can be performed at the same time and on a succession of trays. Once the system is primed, the tray throughput rate can be gated at the longest single in-line operation. In an embodiment, the system can be designed for a throughput of an average of about 20 trays per minute, measured over about a one-hour period with a minimum threshold average of about 15 trays per minute over one hour. In certain embodiments, a reliability objective of the system can be to have fewer than about 4 unplanned stoppages requiring operator intervention per hour.

In an embodiment of the present invention, unsleeving system 150, as seen in FIG. 1(*b*), includes a tray-transport 200 that connects to an upstream system 202 and receives, for example, SSTs. Included in tray-transport 200 are sensors capable of determining the size of the received SSTs. In certain embodiments, a destrapping station 300, discussed in greater detail in the description of FIG. 3, automatically cuts and removes strap 120. The sleeved trays are then fed to an unsleeving station 400 that removes tray 102 from sleeve 110. At this stage, tray 102 is pushed along downstream 902 for further processing. At a sleeve-transport conveyor 500, empty sleeves 110 are placed on a transport belt and moved to a sleeve-stacking station 600. Empty sleeves 110 are sorted according to previous size determinations made by the sensors in the transport 200 and stacked for reuse in sorting baskets 660. Unsleeving system 150 is enclosed for safety in a safety enclosure 700. Emergency stop (E-stop) switches are located conveniently along unsleeving system 150. Control system 800, typically run by a computer, helps efficiently run unsleeving system 150.

The foregoing description follows a logical progression of steps through the various stations. As one of ordinary skill in the art will recognize, however, no set order of operations, number of operations, or number of stations is necessary. The stations can be in a different order and some stations need not be included in order to un-sleeve a tray.

Figure 2A:
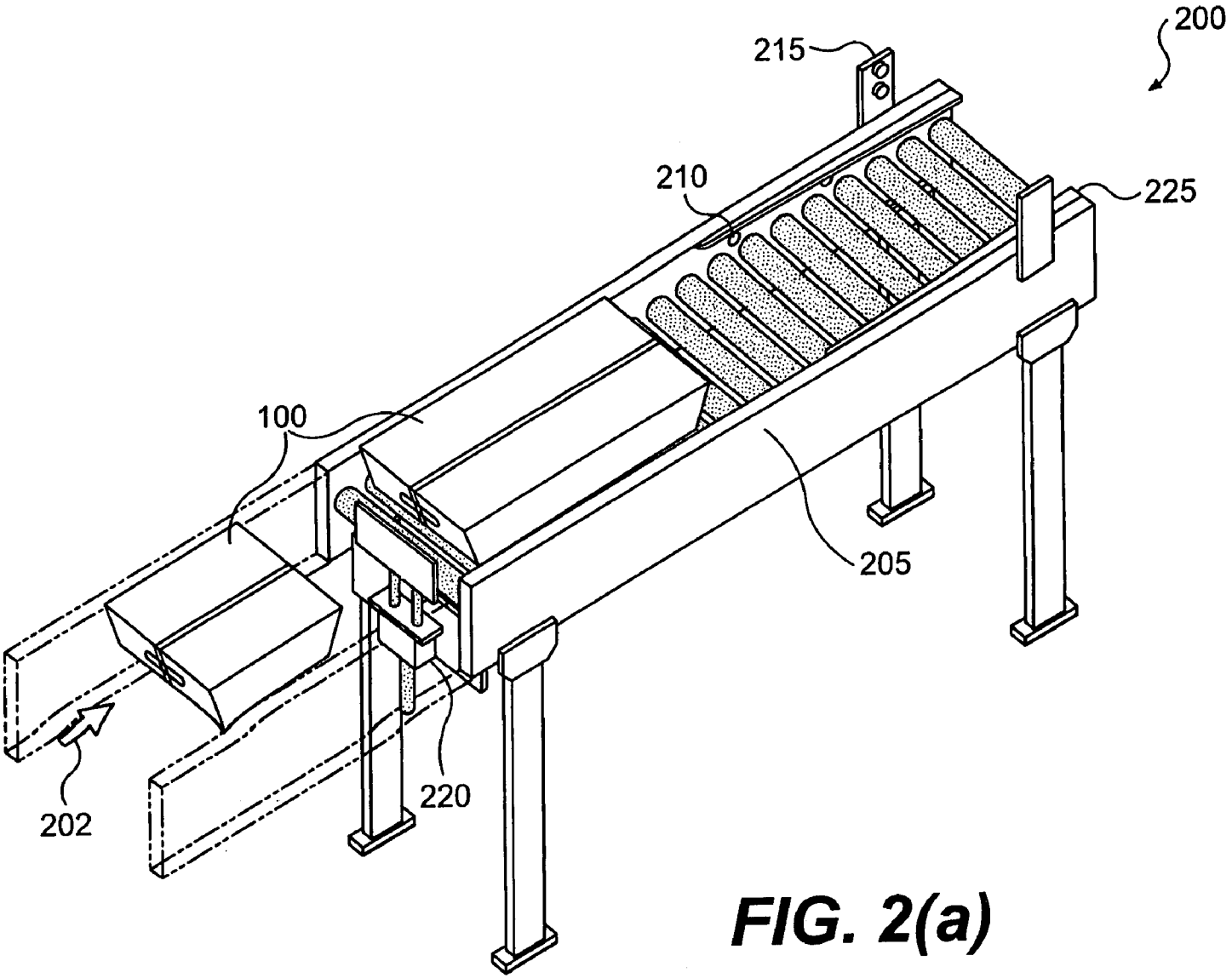
FIG. 2(*a*) is a perspective view of one embodiment of the tray-transport/tray-sizing station consistent with the principles of the invention.
Figure 2B:
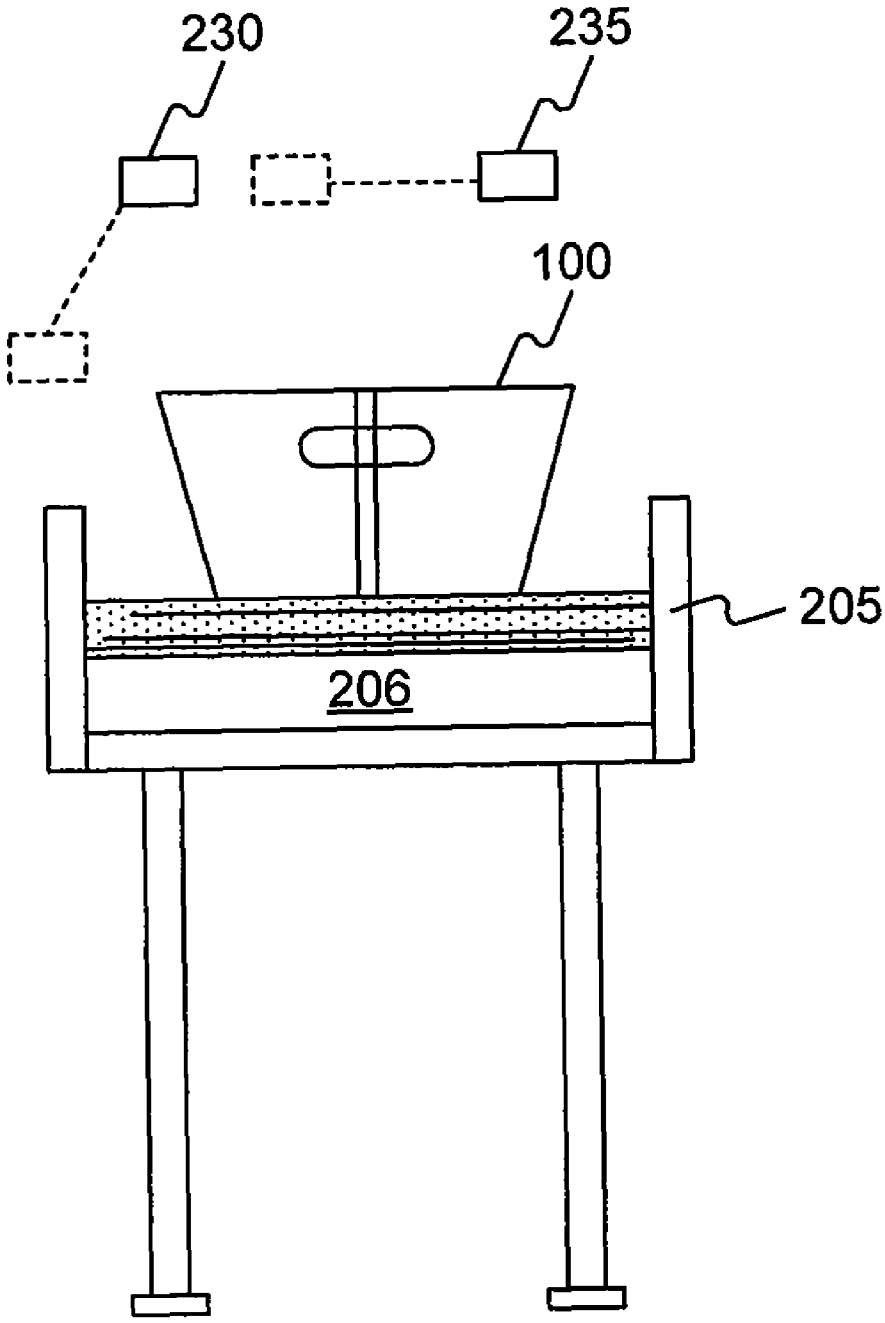

As depicted in FIGS. 2(*a*) and 2(*b*), in certain embodiments of the invention, a tray-transport 200 moves SSTs 100. Moving SSTs 100 is accomplished, for example, with a powered roller, such as a zero-pressure accumulation conveyor 205, which has a relatively quiet operation. Conveyor 205 can be any stable platform that transports SSTs 100. In one embodiment, the conveyor can be integrated with upstream and downstream conveyors and can accommodate those conveyors' height above the floor, for example, by using adjustable legs. In one embodiment, tray-transport 200 can be equipped with a mail catcher 206, such as a sheet and an expanded metal filler plate to catch any item that might become loose in unsleeving system 150.

In certain embodiments, length sensors 210 and height sensors 215 are integrated into tray-transport system 200 and measure tray length and tray height. Length sensor 210 and height sensor 215 can be, for example, light sensitive sensors, such as photo-reflective zone sensors. Alternatively, physical-type sensors can also be used, such as contact arm microswitches. In one embodiment, tray-transport 200, as well as unsleeving system 150, is integrated into a straight section of a power roller conveyor and this can be accomplished by an interlock to an upstream conveyor. In some embodiments, a traffic control device 220 is included to assist upstream traffic control. In one embodiment, tray centering guides 225 are included to guide SSTs as they pass through unsleeving system 150.

In an embodiment, a tray-sizing station 200 determines the tray type, which is used to properly separate sleeves 110 for later use. Length sensors 210 and height sensors 215 can be horizontal and vertical discrete sensor arrays, respectively, and logically determine the tray type from the SST's dimensions. In certain embodiments, length sensors 210 detect, for example, tray length/size of ½ to full size, and height sensors 215 detect, for example, tray height/size of MM or EMM. In an embodiment that uses a light sensitive sensor, there are emitter and receiver paired-type sensors that eliminate false records. In some situations in certain embodiments, SSTs can be overstuffed, in which case, SSTs of equal height can be treated alike. For example, MM trays that are overstuffed to the same height as EMM trays are treated as EMM trays.

Figure 3A:
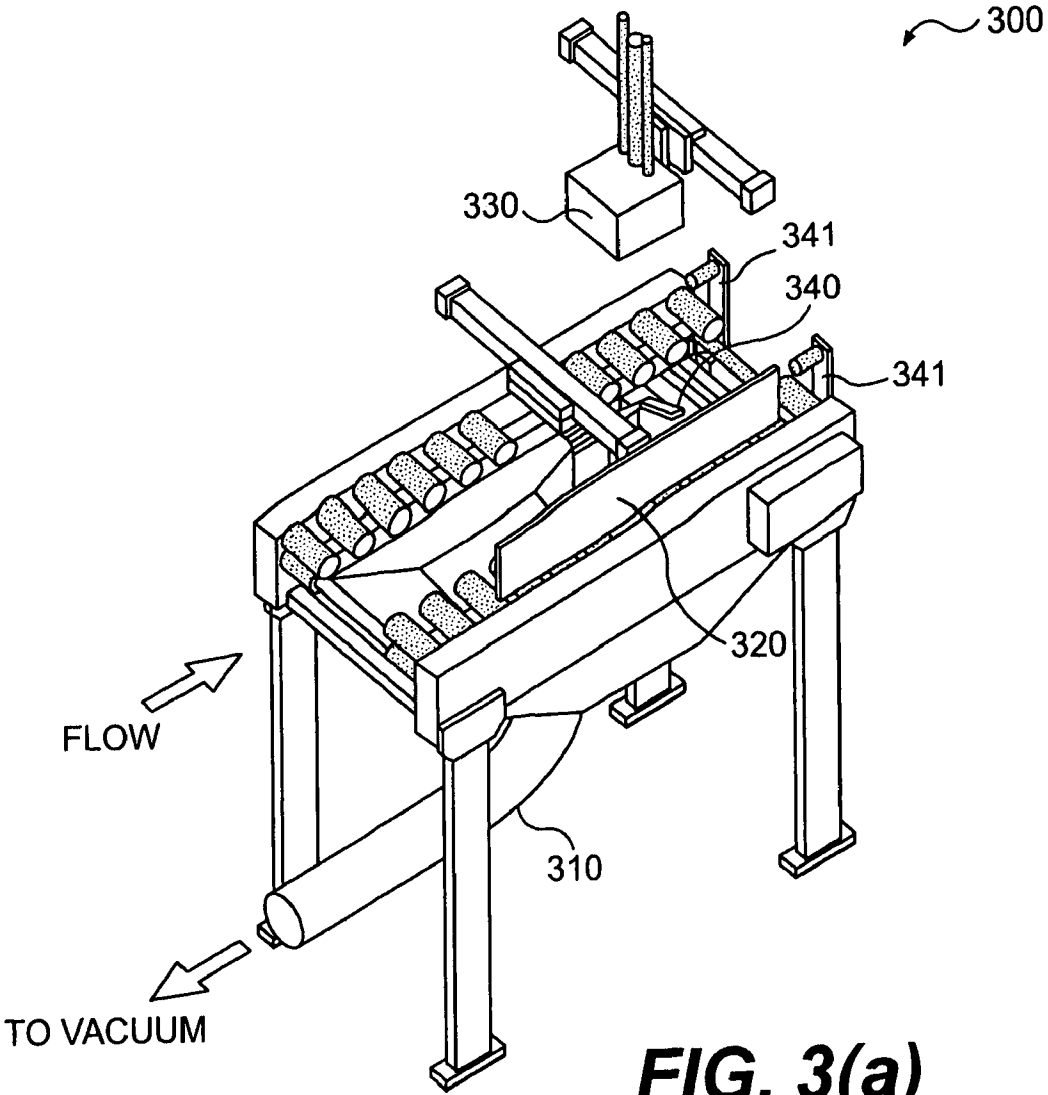
FIG. 3(*a*) is a perspective view of one embodiment of the destrapping station consistent with the principles of the invention.
Figure 3B:
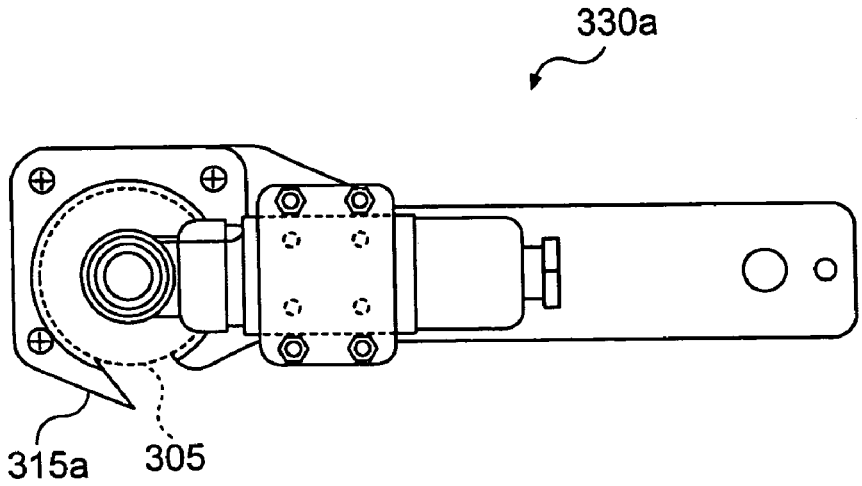
Figure 3C:
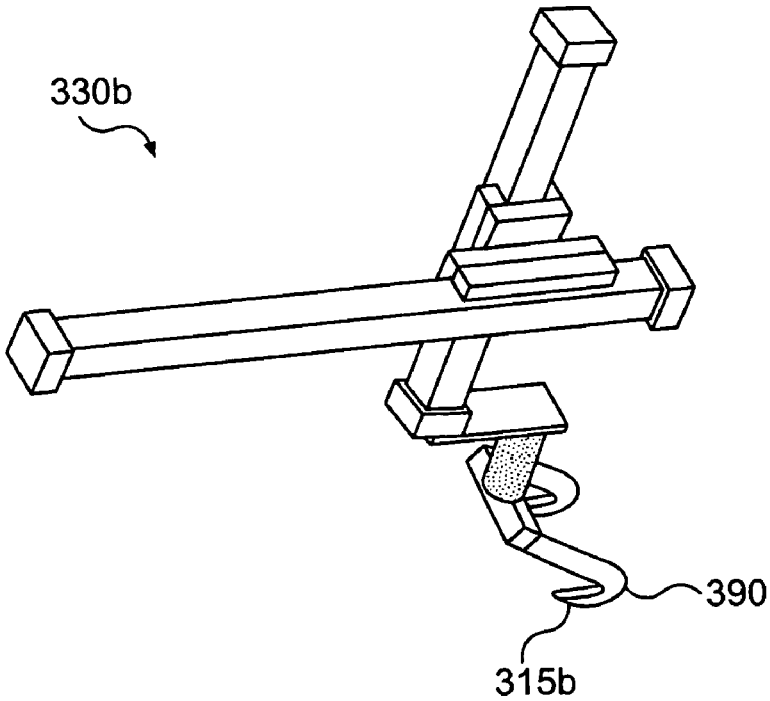

In an embodiment of the present invention shown in FIG. 3(*a*), trays are fed from tray-sizing station 200 to a destrapping station 300 that simultaneously cuts and pulls strap 120 from an SST. In an embodiment, cut strap 120 is fed to a vacuum takeaway 310 and storage system (not shown). Destrapping station 300 is equipped with a transfer device 320 to positively and quickly push a de-strapped tray into unsleeving station 400. A strap cutter 330 cuts strap 120. In certain embodiments, destrapping station 300 makes use of the natural tendency of a cut strap to fall down through a de-strap window (not shown).

Although the embodiment of FIG. 3(*a*) depicts strap cutter 330 as cutting strap 120 from the top of SST 100, the strap cutter 330 may alternately cut strap 120 from the side of SST 100 (not shown).

In an embodiment shown in FIG. 3(*b*), strap cutter 330*a* comprises a rotating saw blade 305 and a flexible spatula 315*a*. Strap 120 is picked up off the surface of SST 100 by flexible spatula 315*a* and guided to rotating saw blade 305 as SST 100 is fed through destrapping station 300. Rotating saw blade 305 cuts strap 120 when contact is made.

In an alternate embodiment shown in FIG. 3(*c*), strap cutter 330*b* includes a hooked blade 390 in combination with flexible spatula 315*b*. In this embodiment, strap 120 is similarly picked up off the surface of SST 100 by flexible spatula 315*b*. Strap 120 is guided to the inside cutting edge of hooked blade 390. The cutting edge on hooked blade 390 cuts strap 120 as the SST is fed through.

In certain situations rotating saw blade 305 is preferred, such as when SST 100 is not heavy. Hooked blade 390 may not be able to cut strap 120 in this situation because the weight of SST 100, as felt by strap 120 suspended on hooked blade 390, may be insufficient to overcome the strength of strap 120. If this happens, strap 120 may not be cut. SST 100 can end up suspended by strap 120 on hooked blade 390. In an embodiment, this problem is solved by using rotating saw blade 305 because cutting strap 120 is not dependent on the weight of SST 100. Rather, as flexible spatula 315 (or hook) lifts strap 120 up off a SST 100, strap 120 engages rotating saw blade 305, which cuts through strap 120.

One of ordinary skill will realize that many other embodiments of means for cutting strap 120 are within the principles of the present invention. For example, rotating saw blade 305 may be replaced or augmented by a moving band saw blade, a coping saw blade, or a jigsaw blade. For another example, hooked blade 390 may be replaced or augmented by a heating system, so that hooked blade 390 melts strap 120 in lieu of, or in addition to, cutting. For another example, rotating saw blade 305 may be replaced or augmented by a laser cutting beam, high-pressure cutting liquid jet, or chemical solvent that disintegrates a portion of strap 120.

Referring back to FIG. 3(*a*), in certain embodiments of the present invention, a strap-removal portion 340 provides a means of aiding strap cutter 330. When strap 120 is cut, strap-removal portion 340 pulls strap 120 into a sleeved tray that feeds vacuum takeaway system 310. The strap-removal function is done below SST 100 to take advantage of the natural tendency of cut strap 120 to fall. In one embodiment, speed can be improved if strap-removal portion 340 grasps strap 120 at its center rather than at one of its ends. In other embodiments, the strap-removal portion 340 uses opposing pinch wheels in a configuration that contacts the strap 120 and SST 100 and pulls the strap 120 away from the SST 100 by virtue of the speed and grip of the wheels.

In one embodiment, strap cutter 330 and strap-removal portion 340 can use similar designs. In one example, they are constructed as an offset x-y manipulator with a pair of rodless pneumatic cylinders mounted in an "L" configuration. The ends of each can share a similar design that employs a flexible spatula-type device that contacts sleeve 110 (both top and bottom) and engages strap 120, by sliding between strap 120 and sleeve 110.

In an embodiment of the present invention, strap takeaway system is a vacuum-powered device that sucks a fallen strap down a passage 310 to a strap collection canister (not shown). The strap collection canister may be separated from the unsleeving system 150 and uses a standard and reusable container with a vacuum blower unit as a lid. Cut straps need not be removed from the container, rather, only the container need be changed out.

In certain embodiments of the present invention, an integral strap chopping system (not shown) can be used. Fallen cut straps are put through a chopper before they enter the strap collection canister. Alternatively, an off-line machine, where straps can be chopped up without the possibility of interfering with the operation, can be used.

Figure 4A:
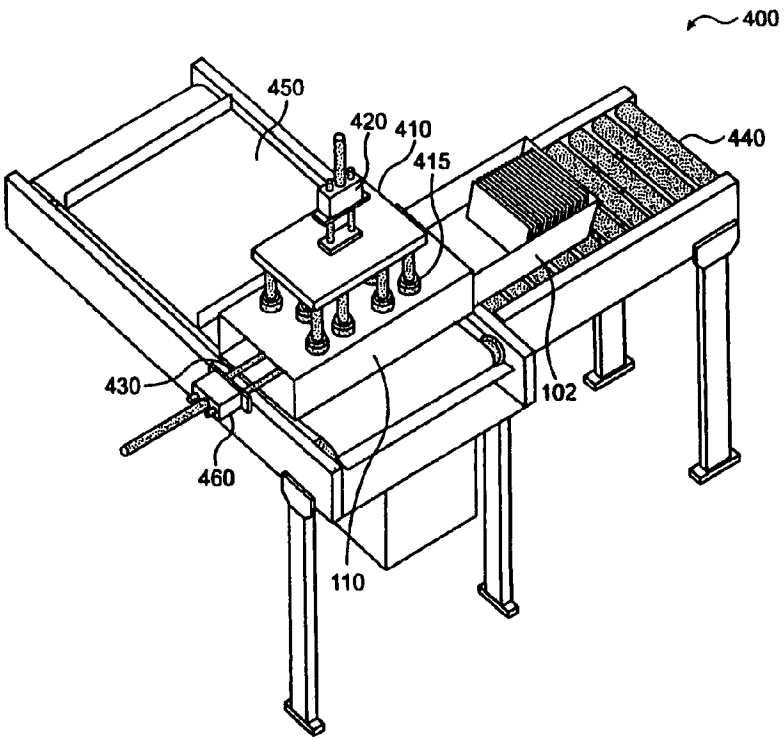
FIG. 4*a*is a perspective view of one embodiment of the unsleeving station consistent with the principles of the invention.
Figure 4B:
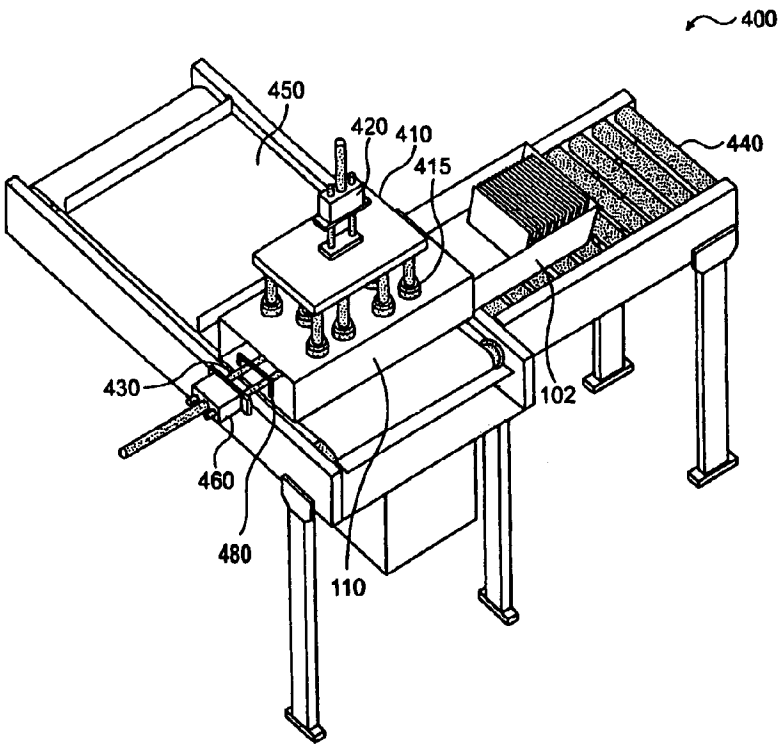
FIG. 4*b*is a perspective view of one embodiment of the unsleeving station of FIG. 4*a* showing a push ram comprising a sweeping device.

As depicted in FIG. 4, separation of trays 102 from sleeves 110 in SST 100 may be accomplished at an unsleeving station 400. In an embodiment of the present invention, tray 102 removal is accomplished without damage to tray 102, sleeve 110, items 101, or any other components, by slightly lifting the top of sleeve 110 at unsleeving station 400. In certain embodiments, this is accomplished with a sleeve-expander 410 equipped with at least one gripper 415 that grips sleeve 110 of SST 100 after strap 120 has been removed. Gripper 415 can be, for example, vacuum cups as shown in FIG. 4 that grip the top of sleeve 110. Gripper 415 may also grip the bottom of sleeve 110 (not shown). Alternatively, gripper 415 can be small hooks, tacky surfaces, or any other method of stably gripping sleeve 110. In an embodiment, sleeve-expander 410 is moved vertically to slightly lift the top of sleeve 110 by a linear actuator assembly 420. A push ram 430 actuated, for example, by a linear actuator 460 pushes tray 102 out from expanded sleeve 110. In some instances, sleeves 110 on tray 102 can be caved-in from stacking or sleeve 110 can bulge out if tray 102 is very full. By gripping sleeve 110 and slightly lifting, tray 102 can be pushed out with push ram 430 despite the bulging or caving-in of sleeve 110.

In a further embodiment, push ram 430 comprises a mail sweeping device 480 configured to clear letters 101 that may have fallen out of tray 102 into sleeve 110. In at least one embodiment, the sweeping device 480 comprises a brush or flexible flap (not shown) to push loose letters 101 out of sleeve 110 as ram 430 simultaneously pushes tray 102.

If the system fails to cut strap 120 upstream or sleeve 110 is jammed on the tray 102 in such a way that tray 102 cannot be removed from sleeve 110, gripper 415 can be overridden by push ram 430 and SST 100 can be pushed to the out-feed conveyor 440. This allows unsleeving system 400 to pass a failed SST 100 without stoppage of flow. If manual handling is not desired at this stage, an automatic strap or sleeve-detection system is used to reject SST 100 downstream. Otherwise, an operator pulls SST 100 out of the flow for manual unsleeving.

Figure 5:
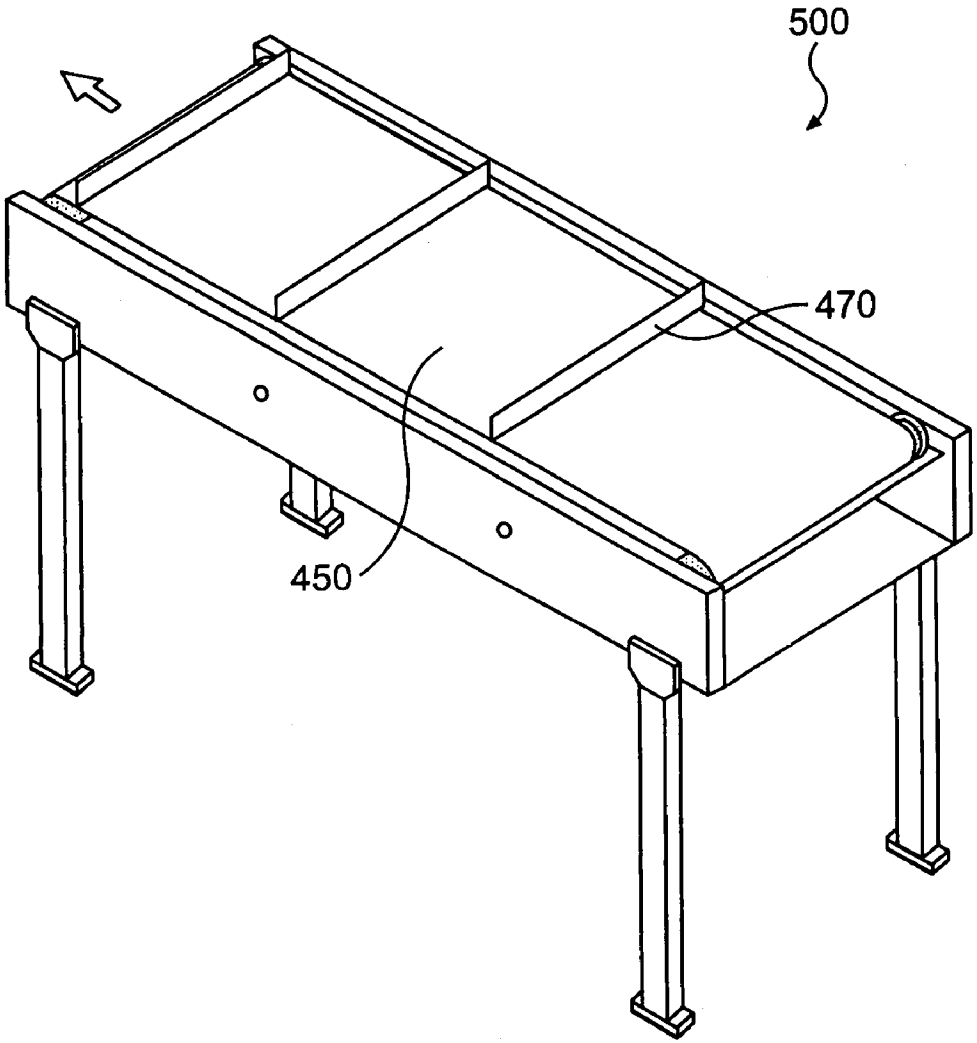
FIG. 5 is a perspective view of one embodiment of the sleeve-transport conveyor consistent with the principles of the invention.
Figure 6:
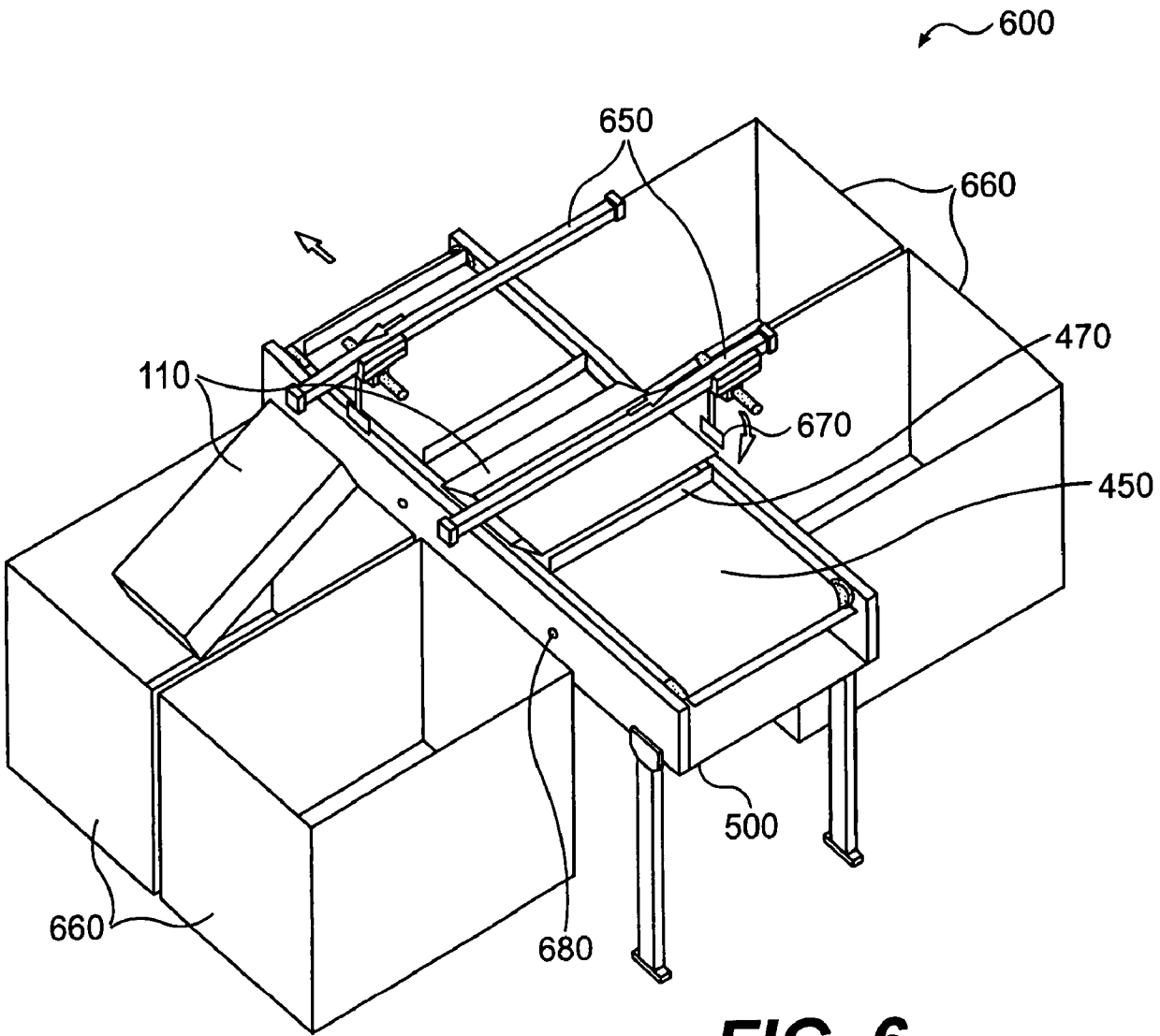
FIG. 6 is a perspective view of one embodiment of the stacking/sortation station consistent with the principles of the invention.
Figure 7:
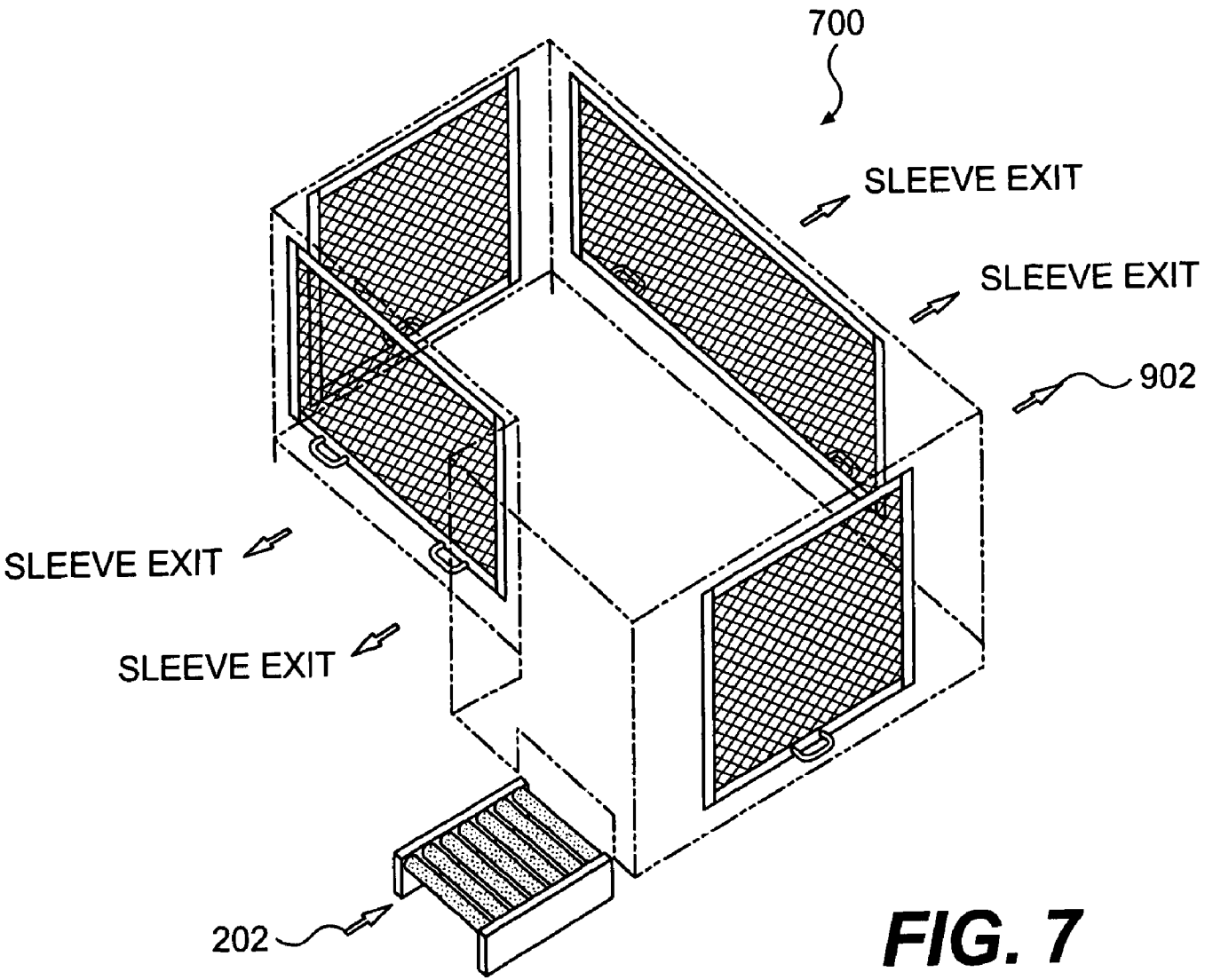
FIG. 7 is a perspective view of one embodiment of the safety enclosure consistent with the principles of the invention.

As depicted in FIGS. 5 and 6, in an embodiment of the present invention, a cleated belt 450 positively transports empty sleeves 110 in an indexing motion aligned with sleeve containers 660. In certain embodiments, cleated belt 450 is a standard type conveyor belt with cleats 470 across its width that can be spaced to accommodate a plurality of sleeves 110, for example, one to five along its length. In an embodiment, the cleats 470 positively locate each sleeve 110 and define different stations for operations. Cleated belt 450 can be, for example, driven by a clutch and can move with an indexing motion, advancing sleeves 110 one station at a time from unsleeving station 400 through to sleeve-ejector 650.

Referring to FIGS. 1(*b*) and 6, in at least one embodiment, depending on the sleeve size, sleeve-ejectors 650 are configured to transfer sleeve 110 into its associated container. The associated container may be based on the sleeve size as measured by tray-sizing station 200. In one embodiment, two sleeve-ejectors 650 are mounted above a sleeve-transport conveyor 500, as shown in FIG. 6. In an embodiment, sleeve-ejectors 650 are bi-directional and sweep empty sleeves 110 into containers 660 located at either side of sleeve-transport conveyor 500.

In an embodiment, a pusher paddle 670, on a rotary actuator mounted on a rodless cylinder, for example, is positioned at either end of sleeve 110 for ejection of sleeve 110 into one of several sleeve containers 660, depending on the sleeve type. In an embodiment of the present invention, pusher paddles 670 flatten sleeve 110 in a consistent direction before ejecting it into sleeve container 660 as seen in FIG. 6. This function allows direct loading of stacks of sleeves 110 into an external device, such as an automatic sleever (not shown).

In one embodiment, a plurality of sleeve containers 660 is positioned on either side of sleeve-ejectors 650 and is located on the floor with a fixture. In one embodiment, sleeve containers 660 have no physical interface with unsleeving system 150. However, in another embodiment, presence sensors (not shown) can be used to confirm that sleeve containers 660 are in their correct positions.

In some embodiments, the station 600 comprises a device (not shown) configured to rotate empty sleeve 110 before the sleeve is pushed into container 660. For example, it may be desired to stack folded sleeves 110 in container 660 so that the sleeves 110 are each oriented similarly to one another, with folds facing the same direction. Accordingly, it may be necessary to rotate the empty and folded sleeve 110 90° or 180° before the sleeves 110 are stacked in container 660.

In certain embodiments of the present invention, over-height stacking is sensed by a basket-full sensor 680 mounted on the sleeve-ejector frame. Basket-full sensor 680 can be any light type sensor, such as a photo eye, or any mechanical sensor. Because of the sleeve container interface, the sleeve-stacking/sortation station 600 can be easily configured to use a variety of containers and can be adapted to a local facility's performance and practice.

In an embodiment of the present invention, unsleeving system 150 is controlled with software running on a computer. Distributed I/O can be utilized for the sensor.and actuator interface. The controller software executes an application on the same computer that provides the operator with a user-friendly, graphical, human machine interface ("HMI"). In an embodiment, the HMI provides a color-coded system operation status, as well as maintenance, diagnostic and reporting features.

In certain embodiments, the central system can detect actual conditions rather than relying on assumptions, so that it can handle unexpected situations. The control software allows for key timing and control parameters to be modified at run-time without going into the source code and without requiring any programming expertise.

Figure 8:
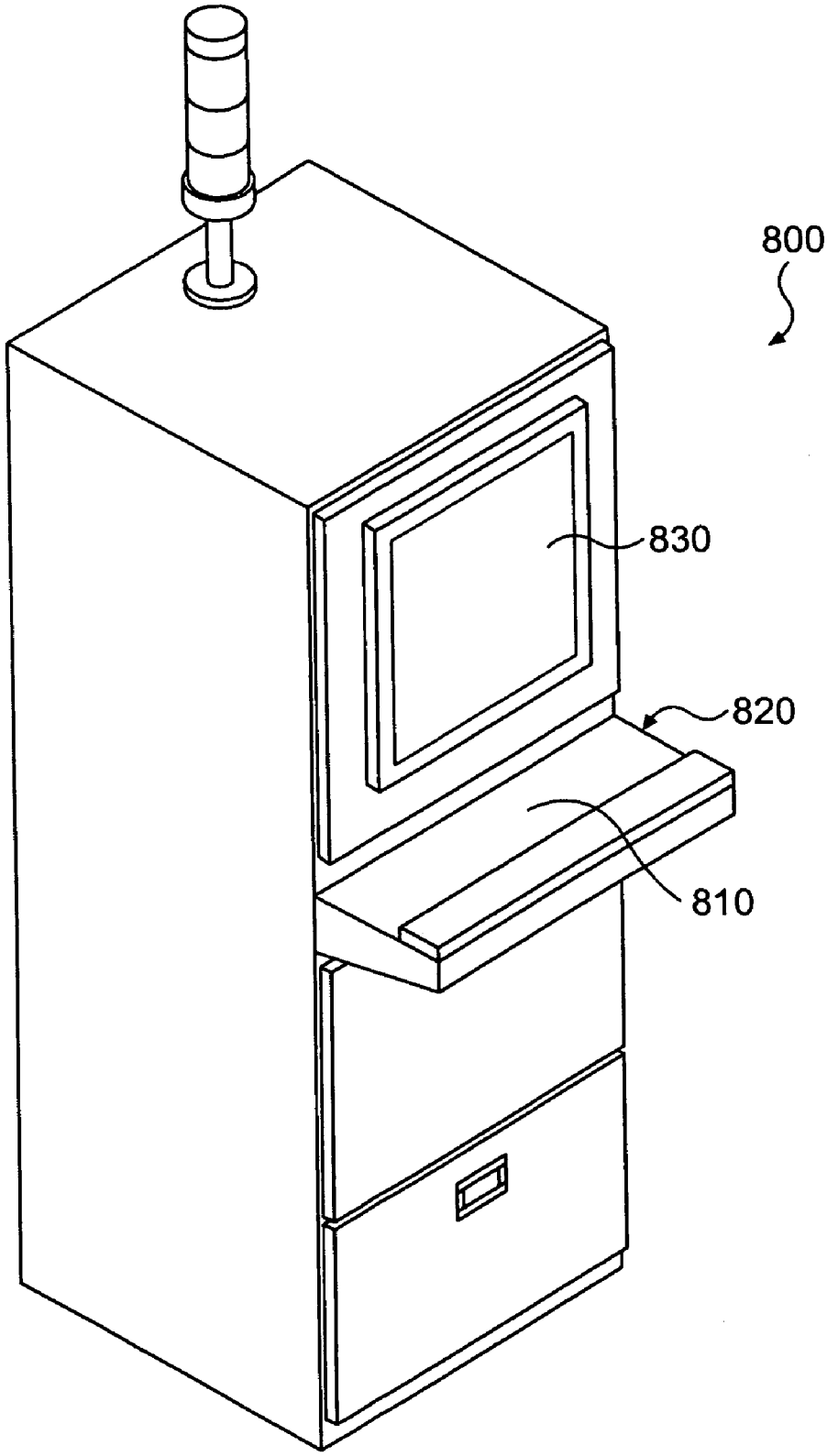
FIG. 8 is a perspective view of one embodiment of the control system consistent with the principles of the invention.

As depicted in FIG. 8, in other embodiments, all control components, power distribution components, and interfaces to the host facility's air and power may be located in a single industrial control enclosure 800, which is outside the safety enclosure 700, as depicted in FIGS. 1(*b*) and 7. External controls 810 on control panels 820 on the front of the control enclosure 800 can provide an easily accessible means to Emergency-stop ("E-stop") the system, as well as to start, stop, control and monitor the system operation. A display 830 is included to provide a user-friendly machine interface with both graphic and alphanumeric displays of normal status, faults and diagnostic conditions. Display 830 can be a standard industrial flat panel that produces no ionizing radiation or a CRT. In an embodiment, an elevated light stack and audible alarms provide status and safety cues for the operating personnel. These status and safety cues include start-up warnings, E-stop alarms, and running indications. The primary power switch on the enclosure is equipped to accept a standard lockout device. A system identification label plate is mounted on the front of the control enclosure. In certain embodiments of the present invention, cooling of the control enclosure 800 can be provided by an internal fan (not shown) that circulates air. No external discharge of air would be necessary.

In an embodiment, control components can coordinate the operation of system elements including, for example, tray-transport/tray-sizing station 200, destrapping station 300, unsleeving station 400, sleeve-transport conveyor 500, sleeve-stacking/sortation station 600, etc. The operation of each system element is more fully described above. For example, the control components can direct the sleeve-stacking/sortation center 600 to put sleeves into certain baskets 660 based on the signals previously received from the length sensors 210 and height sensors 215.

A description of the operation of the embodiment of FIG. 1(*b*) will now be made. In operation, SSTs 100 are sent down conveyor 205 of tray-transport 200. Traffic control device 220 physically prevents SSTs 100 from entering de-strapping station 300 if an SST 100 is currently being de-strapped. In this embodiment, traffic control device 220 comprises a vertical actuator that raises and lowers the device 220 to impede the SST's 100 access to conveyor 205.

Once the system 150 is ready to destrap SST 100, traffic control device 220 lowers to allow the SST to slide along conveyor 205 of tray-transport 200. The SST 100 slides to tray stop 341, which stops SST from sliding, at destrapping station 300. Once at station 300, strap cutter 330 is lowered toward SST 100 and positioned near strap 120. Once strap cutter 330 is near strap 120, strap cutter 330 is moved horizontally on SST 100, so that flexible spatula 315 (or hook) can pry strap 120 away from SST. Once strap 120 is pried away from tray 102, the blade of strap cutter 330 cuts the strap 120. After the strap 120 is cut, strap removal tool 340, which is positioned below SST 100, pulls the cut strap 120 away from SST. Once the cut strap 120 is pulled away from SST 100, the strap 120 is sent down vacuum takeaway 310 for later disposal.

The now de-strapped SST 100 is pushed by transfer device 320 onto cleated belt 450 of unsleeving station 400. Once SST 100 is on station 400 and below sleeve-expander 410, sleeve-expander 410 is lowered with linear actuator 420 so that gripper 415 grips sleeve 110. Once gripper 415 grips sleeve 110, another linear actuator 460 moves push ram 430 horizontally toward SST 100. Push ram 430 pushes tray 102 out of sleeve 110, as depicted in FIG. 4. Once tray 102 is removed from sleeve 110, tray 102 slides down out-feed conveyor 440 for further processing.

Cleated belt 450 then transports empty sleeve 110 toward sleeve stacking/sortation station 600. Belt 450 transports and positions sleeve 110 under sleeve ejector 650. Sleeve ejector 650 includes a linear actuator for horizontally moving the sleeves 110 to containers 660. Once sleeve 110 is positioned under ejector 650, ejector 650 pushes the empty sleeves 110 into one of the containers 660 for later collection and reuse.

It will be apparent to those skilled in the art that various modifications and variations can be made to the structure and methodology described herein. Thus, it should be understood that the invention is not limited to the subject matter discussed in the specification. Rather, the present invention is intended to cover modifications and variations.

What is claimed is:

1. An automated system for unstrapping and unsleeving a tray, comprising:

a tray transport, which transports a tray in the system;

a sleeve-sensing portion that receives the tray being transported by the tray transport and detects whether the tray includes a sleeve, the sleeve-sensing portion comprising:

a first sensor positioned at an angle to the received tray to sense mail pieces and to generate an indication, when mail pieces are sensed, that the tray does not include a sleeve, and a second sensor positioned above the received tray to sense a surface of the tray and a height of the tray and to generate an indication, when the surface is sensed as smooth and when the height of the tray is sensed as taller than the height of an unsleeved tray, that the tray includes a sleeve;

a size-sensing portion that receives the tray being transported by the tray transport, the size-sensing portion comprising a length sensor and a height sensor and determining a tray type from a sensed length and a sensed height;

a strap cutter, which receives the tray from the size-sensing portion and cuts a strap on the tray;

a strap-removal portion, which removes the strap cut by the strap cutter; and an unsleeving station, which removes a sleeve from the tray when the tray is detected to include a sleeve;

wherein the unsleeving station removes the sleeve from the tray after the strap-removal portion removes the cut strap, and wherein if the sleeve sensing portion does not detect that the tray includes a sleeve, the system transports the tray through the strap cutter, the strap-removal portion, and the unsleeving station without processing.

2. The system of claim 1, wherein the first sensor and the second sensor comprise ultrasonic sensors.

3. The system of claim 1, wherein the first sensor and the second sensor comprise photo-sensitive sensors.

4. The system of claim 1, wherein the tray transport comprises a traffic control device, having a raised position and a lowered position, that physically prevents the tray from being transported in the system.

5. The system of claim 1, further comprising a sleeve-transport conveyor that moves empty sleeves.

6. The system of claim 1, further comprising a safety enclosure that protects personnel from injury during system operation.

7. The system of claim 1, further comprising a control system that controls and monitors the system.

8. The system of claim 7, wherein the control system comprises a computer.

9. The system of claim 1, further comprising at least one emergency stop switch that stops the system.

10. The system of claim 1, wherein the tray transport comprises a powered roller.

11. The system of claim 10, wherein the powered roller is a zero-pressure accumulation conveyor.

12. The system of claim 1, wherein the tray transport comprises a mail catcher configured to catch loose items.

13. The system of claim 1, wherein the tray transport comprises a tray-centering guide that centers the tray.

14. The system of claim 1, wherein the strap-removal portion comprises a vacuum takeaway.

15. The system of claim 1, further comprising a transfer device that pushes the tray onto the unsleeving station after the strap is cut and removed.

16. The system of claim 1, wherein the strap cutter comprises a rotating saw blade and a flexible spatula.

17. The system of claim 1, wherein the strap cutter comprises a hooked blade and a flexible spatula.

18. The system of claim 1, wherein the strap cutter cuts the strap above the tray and the strap-removal portion removes the cut strap below the tray.

19. The system of claim 1, wherein the strap-removal portion removes the cut strap near the center of the cut strap.

20. The system of claim 1, wherein the strap-removal portion comprises a strap-chopping portion that chops the cut strap.

21. The system of claim 1, wherein the unsleeving station comprises a sleeve expander that lifts a top of the sleeve.

22. The system of claim 21, wherein the sleeve expander comprises a gripper that grips the top of the sleeve.

23. The system of claim 22, wherein the gripper comprises vacuum cups.

24. The system of claim 1, wherein the unsleeving station comprises a push ram that pushes the tray out of the sleeve.

25. The system of claim 24, wherein the push ram comprises a sweeping device that removes loose mail from an empty sleeve.

26. The system of claim 1, further comprising a sleeve-sorting station that sorts empty sleeves.

27. The system of claim 26, wherein the unsleeving station comprises a sleeve-transport conveyor that transports empty sleeves to the sleeve-sorting station.

28. The system of claim 26, wherein the sleeve-sorting station comprises at least one container.

29. The system of claim 28, wherein the sleeve-sorting station further comprises at least one sleeve ejector that sweeps empty sleeves into the at least one container.

30. The system of claim 29, wherein the at least one sleeve ejector comprises at least one pusher paddle that flattens the empty sleeve before sweeping the empty sleeve into the at least one container.

31. The system of claim 28, wherein the sleeve-sorting station comprises a floor fixture that positions the container.

32. The system of claim 28, wherein the sleeve-sorting station comprises a basket-full sensor that senses over-height stacking of the empty sleeves in the container.

33. The system of claim 1, wherein the strap cutter comprises:

a flexible spatula and a cutting blade, said spatula being insertable between the strap and the sleeve over the tray; and the strap-removal portion comprises a strap take-away system below the strap cutter having a passageway configured to receive a cut strap from the strap cutter, wherein the cut strap is transported under vacuum through the passageway to a cut strap collection area.

34. The system of claim 1, wherein the length sensor and the height sensor comprise light sensitive sensors.

35. The system of claim 1, wherein the length sensor and the height sensor comprise physical-type sensors.

36. The system of claim 1, wherein the length sensor comprises a horizontal discrete sensor array and the height sensor comprises a vertical discrete sensor array.

37. An automated device for shipping and routing items, the device comprising:

a tray transport for receiving a tray, said tray transport comprising sensors and a receiving station, at least one sensor positioned at an angle to said receiving station to sense mail pieces and to generate an indication, when mail pieces are sensed that the tray does not include a sleeve and at least one sensor spaced apart from said receiving station for determining a tray size and a sleeve size;

a traffic control device, having a raised position and a lowered position, that physically prevents the tray received in the tray transport from being transported;

a destrapping station comprising a strap cutter and a strap take-away system, said destrapping station receiving the tray from said tray transport;

an unsleeving station comprising a sleeve expander and a ram, said unsleeving station receiving the tray from said destrapping station and separating the sleeve from the tray from said destrapping station;

a sleeve-transport conveyor, wherein said sleeve-transport conveyor receives the sleeve from said unsleeving station; and a sleeve-stacking station, wherein said sleeve-stacking station sorts the sleeve according to the sleeve size determined by the at least one sensor spaced apart from said receiving station into a plurality of containers wherein if the at least one sensor positioned at an angle does not detect that the tray includes a sleeve, the system transports the tray through said destrapping station and said unsleeving station without processing.

38. The device of claim 37, comprising a safety enclosure that protects personnel from injury during device operation.

39. The device of claim 37, comprising a control system that controls and monitors the device.

40. The device of claim 37, comprising at least one emergency stop switch that stops the device.

41. The device of claim 37, comprising a transfer device that pushes the tray from said destrapping station to said unsleeving station.

42. The device of claim 37, wherein said sleeve expander lifts a top of the sleeve.

43. The device of claim 42, wherein said sleeve expander comprises a gripper that grips the top of the sleeve.

44. The device of claim 37, wherein the tray transport comprises a powered roller.

* * * * *

UNITED STATES PATENT AND TRADEMARK OFFICE

CERTIFICATE OF CORRECTION

PATENT NO. : 7,758,292 B2
APPLICATION NO. : 11/483735
DATED : July 20, 2010
INVENTOR(S) : Donald R. Close et al.

It is certified that error appears in the above-identified patent and that said Letters Patent is hereby corrected as shown below:

In claim 37, column 12, line 37, "containers" should read --containers and--

Signed and Sealed this

Twenty-first Day of September, 2010

David J. Kappos

David J. Kappos
*Director of the United States Patent and Trademark Office*